US006732615B2

(12) United States Patent
Layaou

(10) Patent No.: US 6,732,615 B2
(45) Date of Patent: May 11, 2004

(54) MULTIPLE-SIZE NUT DRIVER

(76) Inventor: Richard Edward Layaou, 190 N. Moore Rd., #1106, Coppell, TX (US) 75019

( * ) Notice: Subject to any disclaimer, the term of this patent is extended or adjusted under 35 U.S.C. 154(b) by 0 days.

(21) Appl. No.: 09/933,787

(22) Filed: Aug. 20, 2001

(65) Prior Publication Data

US 2002/0023522 A1 Feb. 28, 2002

Related U.S. Application Data

(60) Provisional application No. 60/226,784, filed on Aug. 21, 2000.

(51) Int. Cl.[7] ..... B25B 13/00
(52) U.S. Cl. ..... 81/124.5; 81/185; 81/439
(58) Field of Search ..... 81/124.4, 124.5, 81/185, 439

(56) References Cited

U.S. PATENT DOCUMENTS

| | | | | | |
|---|---|---|---|---|---|
| 1,107,769 | A | * | 8/1914 | Earl et al. | 81/185 |
| 1,471,451 | A | * | 10/1923 | Crimp | 81/124.5 |
| 1,997,948 | A | * | 4/1935 | Pearson | 81/185 |
| 2,711,112 | A | * | 6/1955 | Durand | 81/185 |
| 2,735,325 | A | * | 2/1956 | Rudd | 81/185 |
| 2,822,714 | A | * | 2/1958 | Paparelli | 81/185 |
| 3,187,610 | A | | 6/1965 | Russman | |
| 3,285,106 | A | * | 11/1966 | Svenson | 81/185 |
| 4,213,355 | A | | 7/1980 | Colvin | |
| 4,307,634 | A | * | 12/1981 | Gentry | 81/185 |
| 4,366,733 | A | | 1/1983 | Colvin | |
| 4,417,488 | A | * | 11/1983 | Gentry | 81/124.4 |
| 4,528,875 | A | * | 7/1985 | Hurst et al. | 81/185 |
| 4,676,125 | A | | 6/1987 | Ardelean | |
| 4,909,105 | A | | 3/1990 | Namiki et al. | |
| 4,989,478 | A | | 2/1991 | Trivedi et al. | |
| 5,157,995 | A | * | 10/1992 | Nogues | 81/124.5 |
| 5,163,344 | A | * | 11/1992 | Mathers | 81/124.5 |
| 5,386,749 | A | * | 2/1995 | Kim | 81/185 |
| 5,460,063 | A | | 10/1995 | Hodgson | |
| 5,685,206 | A | | 11/1997 | Ma | |

* cited by examiner

*Primary Examiner*—James G. Smith
(74) *Attorney, Agent, or Firm*—Michael L. Diaz

(57) ABSTRACT

A multiple-size nut driver comprising a socket portion and a handle connected to the socket portion for rotating the socket portion. The socket portion includes a plurality of concentric hexagonal sockets slidably mounted along a longitudinal axis of the driver. Each of the sockets slide between a forward operative position and a rearward retracted position. The handle includes a socket selector mounted behind the plurality of concentric hexagonal sockets. The socket selector holds a selected socket in the forward operative position while allowing unselected sockets to retract to the rearward retracted position. The selected socket is then placed over a nut, and turns the nut when the socket portion is rotated by the handle. Alternatively, the driver automatically selects the proper socket for a given nut by allowing sockets smaller than the nut to be retracted by the nut while the proper size socket and larger remain extended.

8 Claims, 8 Drawing Sheets

MULTIPLE-SIZE NUT DRIVER

PRIORITY STATEMENT UNDER 35 U.S.C. §119 (e) & 37 C.F.R. §1.78

This nonprovisional application claims priority based upon the prior U.S. provisional patent application entitled, "Multiple-Size Nut Driver" application No. 60/226,784, filed Aug. 21, 2000 in the name of Richard Edward Layaou.

BACKGROUND OF THE INVENTION

1. Technical Field of the Invention

This invention relates to hand tools. More particularly, and not by way of any limitation, the invention is directed to a tool having multiple selectable sockets for rotating nuts and other fasteners of multiple sizes.

2. Description of Related Art

When working with mechanical devices, it is often necessary to join two articles together using a nut and bolt arrangement. Typically, a threaded bolt is placed through a hole that runs through the two articles to be joined, and a nut is screwed onto the exposed end of the bolt. In operation, it is necessary to rotate the nut with enough torque to achieve the desired tightness for proper security of the articles being fastened, proper bolt elongation, or both. Achieving the necessary level of torque simply by hand-turning the nut is often difficult, given the limitations of human strength and the impracticability of applying a great deal of force to the relatively small fastener without using some sort of tool.

A variety of tools, such as wrenches and sockets, have been developed for this task. Standard nuts have a hexagonal shape, when viewed along their axis of rotation, but can be any shape that allows a correspondingly shaped tool to effectively engage and turn them. Nuts also come in a varity of standard and sometimes custom sizes, as do nut-driving tools. Some tools, such as an adjustable wrench or pair of pliers, can accommodate a large range of nut sizes, but may slip and cause injury to the human user, damage to the nut being rotated, or both. For this reason fixed-size wrenches or sockets are often preferred.

A socket is a device having an interior portion shaped and sized to engage the nut so that a rotational motion induced in the socket will also turn the nut. To accomplish this function, the socket interior may be the same shape as the nut, for example hexagonal, or it may have a different but nevertheless efficacious shape, such as rounded and having a series of teeth or cogs. The 'size' of the socket is measured by the size of nut it is intended to turn. The exterior of the socket is not a working surface and need have no definite shape, though sockets commonly have a cylindrical exterior for ease of handling and use. A socket is long enough along its longitudinal dimension, that is, along the axis of rotation, so that it can engage the nut and also attach to or receive a means for inducing rotation.

The means for inducing rotation is usually a torque arm extending perpendicular to the axis of rotation that is used to amplify an applied turning force. However, an enlarged gripping portion that can be grasped and hand-turned, similar to a screwdriver, or a mechanical device such as a drill may also be used to induce rotation. The socket may be integrally formed with, fixedly attached, or removably connected to the means for inducing rotation. Socket sizes are not adjustable, and therefore sockets are usually maintained as a set of varying sizes. The entire set is often carried around from job to job. This is not only cumbersome but increases the chance that one of the sockets will be lost or mislaid.

A number of solutions have been attempted to overcome these problems. For example, some wrenches are dual-ended, each end being of a different size, which cuts in half the number of separate tools needed. Other wrenches have moveable jaws that can be adjusted to fit on nuts of different sizes. As another example, some automobile lug wrenches are fashioned in the shape of a cross, and thus able to accommodate four differently-sized sockets. The main shortcomings of these solutions, however, are that only a limited number of sizes can be accommodated before the tool becomes too cumbersome to use, or the configuration of the tool makes it impossible to use the tool in tight working spaces. The cross-shaped lug wrench, for example, while useful for removing lug nuts from automobile wheels, is rarely if ever employed for other auto repairs because it cannot be easily used within the tight confines of the engine compartment.

In order to overcome the disadvantage of existing solutions, it would be advantageous to have a single tool that incorporates nut drivers of varying sizes, and is compact and easy to use in tight spaces. The present invention provides such a tool.

SUMMARY OF THE INVENTION

In one aspect, the present invention is a multiple-size nut driver comprising a socket portion and a handle connected to the socket portion for rotating the socket portion. The socket portion includes a plurality of concentric hexagonal sockets slidably mounted along a longitudinal axis of the driver. Each of the sockets slide longitudinally between a forward operative position and a rearward retracted position. The handle includes a socket selector mounted behind the plurality of concentric hexagonal sockets. The socket selector holds a selected socket in the forward operative position while allowing unselected sockets to retract to the rearward retracted position. The selected socket is then placed over a nut, and turns the nut when the socket portion is rotated by the handle.

In another aspect, the present invention is a self-adjusting multiple-size nut driver comprising a socket portion and a handle connected to the socket portion for rotating the socket portion. The socket portion includes a plurality of concentric hexagonal sockets slidably mounted along a longitudinal axis of the driver, each of the sockets sliding between a forward operative position and a rearward retracted position. A socket spring is mounted behind the plurality of concentric hexagonal sockets. The socket spring biases each socket to the forward operative position, thereby forming a flush front surface of the socket portion comprising a front surface of each of the plurality of sockets. The socket spring has a spring tension that allows sockets having a smaller diameter than the nut to be pushed to the rearward retracted position by the nut when the flush front surface of the socket portion is pushed over the nut by a user. Thus, a socket sized to fit over the nut is automatically selected when the flush front surface of the socket portion is pushed over the nut by the user.

In yet another aspect, the present invention is a multiple-size nut driver designed for use with a drill. The nut driver includes a socket portion, a socket selector paddle, and an extension-bit. The socket portion includes a plurality of concentric hexagonal sockets slidably mounted along a longitudinal axis of the driver, each of the sockets sliding between a forward operative position and a rearward retracted position. The socket selector paddle is mounted behind the plurality of concentric hexagonal sockets. The selector paddle contacts a prong on a selected socket to hold the selected socket in the forward operative position while allowing unselected sockets to retract to the rearward retracted position. The extension-bit is connected to the socket portion for rotating the socket portion with a drill. In this manner, the selected socket is placed over a nut, and turns the nut when the socket portion is rotated by the drill.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The present invention is a device for driving nuts, similar fasteners, and mechanical devices. The nut is a workpiece and is not itself part of the present invention. By way of example, however, it may be a nut, a bolt head, or any similar fastening device driven, that is, advanced or backed-off, by rotation. The nut driver includes a plurality of concentric hexagonal sockets that may be selectively utilized in conventional fashion to fit over nuts of various sizes, or may be utilized as an Allen wrench to fit within a hexagonal depression within the nut. The nut driver of the present invention can also be used for operating other mechanical devices such as valves, switches, or door-latching apparatus where such operation is accomplished by rotating a nut-like feature in order to open the valve, release a locking tab, etc. Other rotationally-operated tools, for example screwdrivers or drill bits, may include, in lieu of a hand-grip, an end shaped so that they can be engaged and turned by a nut driver. For example, interchangeable screwdriver tips (e.g., Phillips, flat head, etc.) may be mounted in the center of the sockets for rotation by the nut driver. Thus, as used herein, 'nut' is intended to broadly include all of these and similar articles.

As noted above, a socket is a device having an interior portion shaped and sized to engage the nut so that a rotational motion induced in the socket will also turn the nut. As used herein, 'socket' is used broadly to include the various types of sockets and similar tool designs. For example, the end of a socket could be fabricated into a set of tines or plates arranged to perform the function of a socket, that is, to receive or engage a nut for turning.

Figure 1:
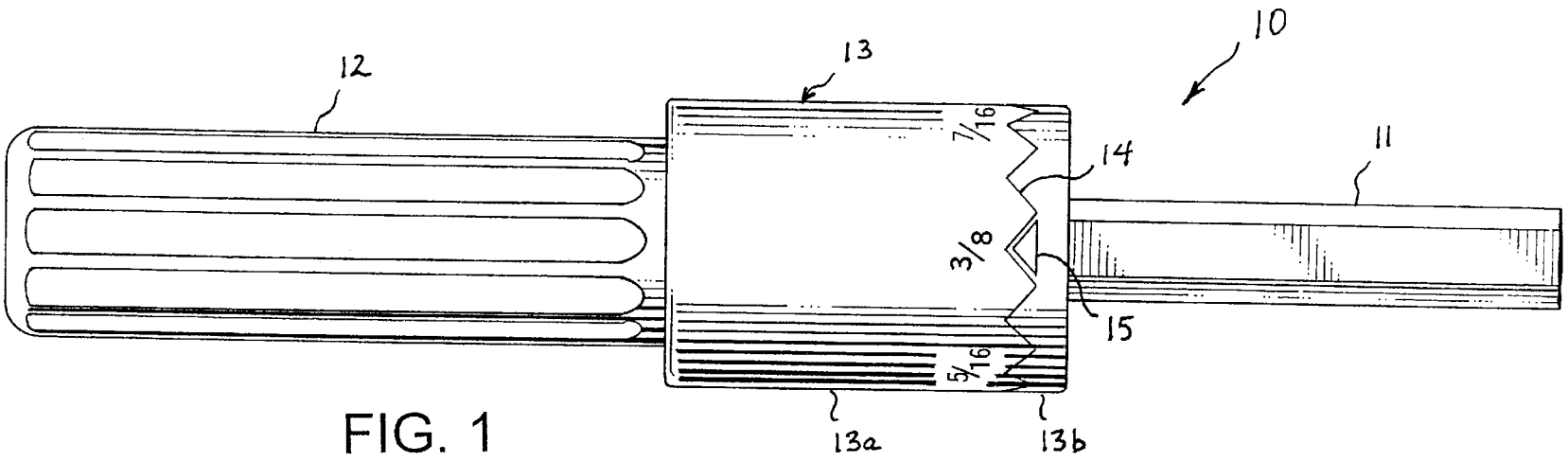
FIG. 1 is a side elevation view of a first embodiment of the nut driver of the present invention.

FIG. 1 is a side elevation view of a first embodiment of the nut driver 10 of the present invention. The nut driver comprises, generally, a socket portion 11 comprising a plurality of concentric sockets, a handle 12, and an optional adjusting mechanism 13. The plurality of sockets are disposed within the handle, which may be formed in whole or in part by the largest socket. Preferably, however, a separate exterior handle grip is provided. The adjusting mechanism may include a rearward portion 13*a* and a forward portion 13*b*. The front edge of the rearward portion and the trailing edge of the forward portion form a set of sawtooth indentations 14 which mate and absorb the forward pressure of the operator. The two portions may be separated longitudinally by the operator. When the two portions are pulled apart, they may be rotated with respect to each other in order to select a desired socket size.

Socket sizes may be selected on the adjusting mechanism 13. For example, an indicator 15 on the forward portion 13*b* may be aligned with a size indication such as "⅜" on the rearward portion 13*a* to select a socket size. A dial on the rearward portion may include in different positions, each of the socket sizes, with the selected size being indicated by the arrow 15 or being visible through a window. In another embodiment, a position indicator tab extends from the forward portion and is received into one of several spaces formed in the rearward portion. The position of the tabbed portion relative to the receiving portion (one of which also controls the position of the selector paddle 23) (see FIG. 2), determines which space the position tab is received into. Each space therefore corresponds to the selection of a certain size socket and may be labeled accordingly. In addition to assisting the tool user in correctly positioning the selector paddle, the position tab may also assist in stabilizing the position of the forward portion of the adjusting mechanism and of the selector paddle itself.

Figure 2:
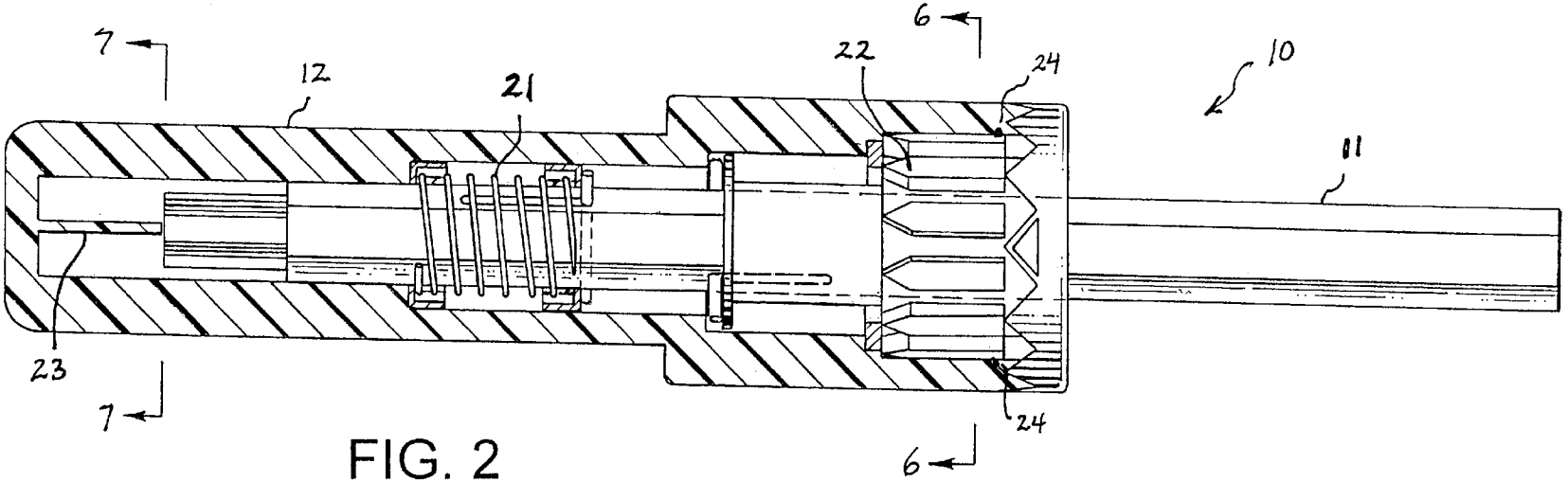
FIG. 2 is a partial longitudinal cross-sectional view of the nut driver of FIG. 1.

FIG. 2 is a partial longitudinal cross-sectional view of the nut driver of FIG. 1. The handle 12 includes an internal spring 21 that is biased to hold the sockets in the extended position. An internal detent and locking ridge 24 hold the rearward portion 13*a* of the adjusting mechanism in contact with the forward portion 13*b*. A series of internal splines 22 prevent rotation of the forward and rearward portions when held together by the spring. A size selector paddle 23 is rotated with the adjusting mechanism to select a desired socket size, as further described below.

Figure 3:
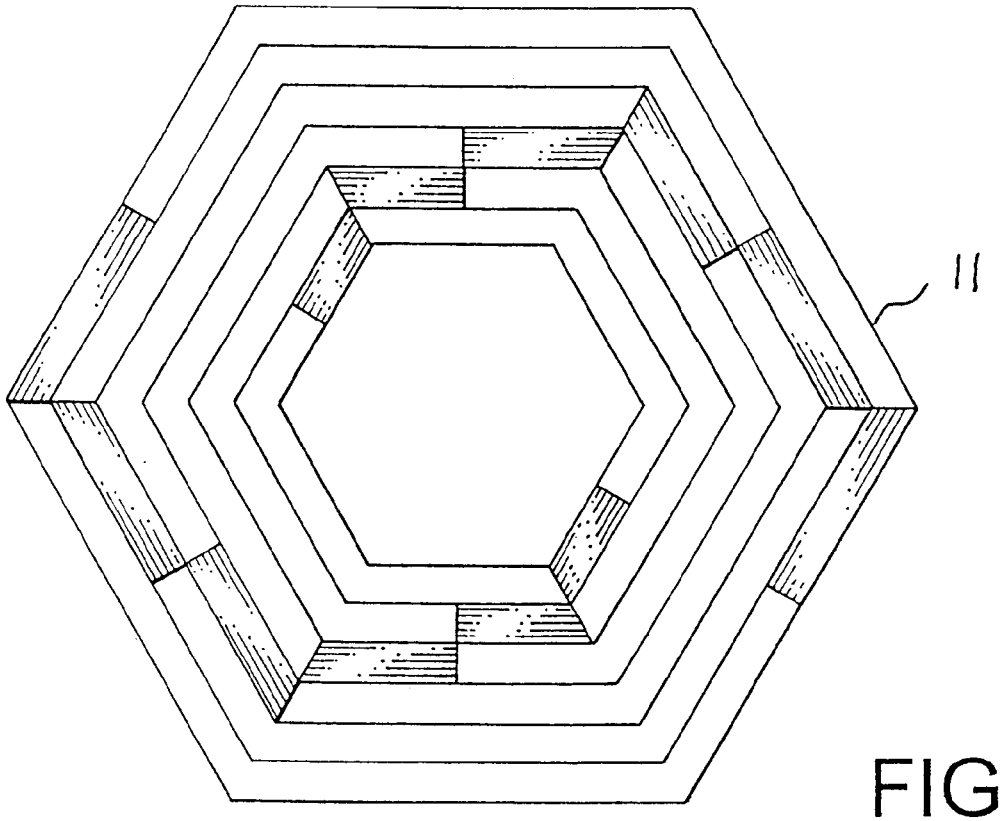
FIG. 3 is a rear elevation view of the socket portion of the nut driver of the present invention illustrating a plurality of concentric nested sockets.

FIG. 3 is a rear elevation view of the socket portion 11 of the nut driver 10 of the present invention illustrating a plurality of concentric nested sockets. In the preferred embodiment, the present invention includes a plurality of concentric sockets for driving nuts, each socket being a different size. The exterior dimension of each socket is smaller than the interior opening formed by the next larger size so that the sockets nest inside each other. In this way when an outer socket turns, it turns the socket inside it. The sockets are slidably mounted in the handle so that when assembled, the sockets each extend and retract individually along the longitudinal axis of the tool (i.e., the axis of rotation).

The shaded portions of the sockets indicate socket prongs that extend rearward from each socket. In the preferred embodiment, each socket has two prongs mounted 180 degrees apart. Each succeeding socket size has two prongs also mounted 180 degrees apart, but angularly displaced from the preceding socket, and occupying a unique angular position. As further described below in connection with FIGS. 7 and 8, the socket prongs are utilized with the size selector paddle 23 to select a particular socket size and to hold the selected socket in the forward operative position.

Figure 4:
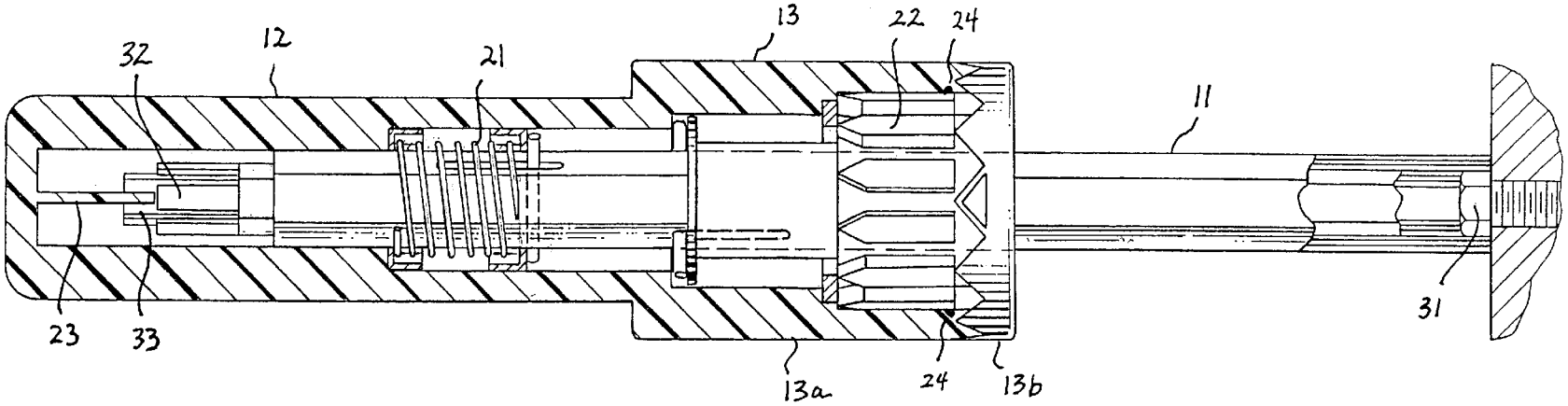
FIG. 4 is a partial longitudinal cross-sectional view of the nut driver of FIG. 1 with the socket portion pressed over an elevated nut.

FIG. 4 is a partial longitudinal cross-sectional view of the nut driver 10 of FIG. 1 with the socket portion pressed over an elevated nut 31. The socket selected for use (the operative socket) 32 is held in the extended position by the selector paddle 23. When the front surface of the socket portion is pressed over the nut, the sockets 33 that are smaller than the nut are pressed rearward into the handle 12. In this way the operative socket remains extended and engaged over the nut. Note that it is not necessary in operation that only one socket be extended; the sockets larger than the operative socket may remain extended if the working space allows. In rare instances, even some of the inner sockets (those smaller than the operable socket and thus inside it) may also remain extended during operation, though the construction of most nuts will usually not permit this. Of course, when the nut driver is used as an allen wrench, the inner sockets remain extended during operation since the sockets fit within a hexagonal depression in the nut.

In an alternative embodiment, the nut driver is self-adjusting, and all sockets are biased forward by a spring. Therefore, all sockets larger than the nut remain in the forward operative position as long as the working space allows.

Figure 5:
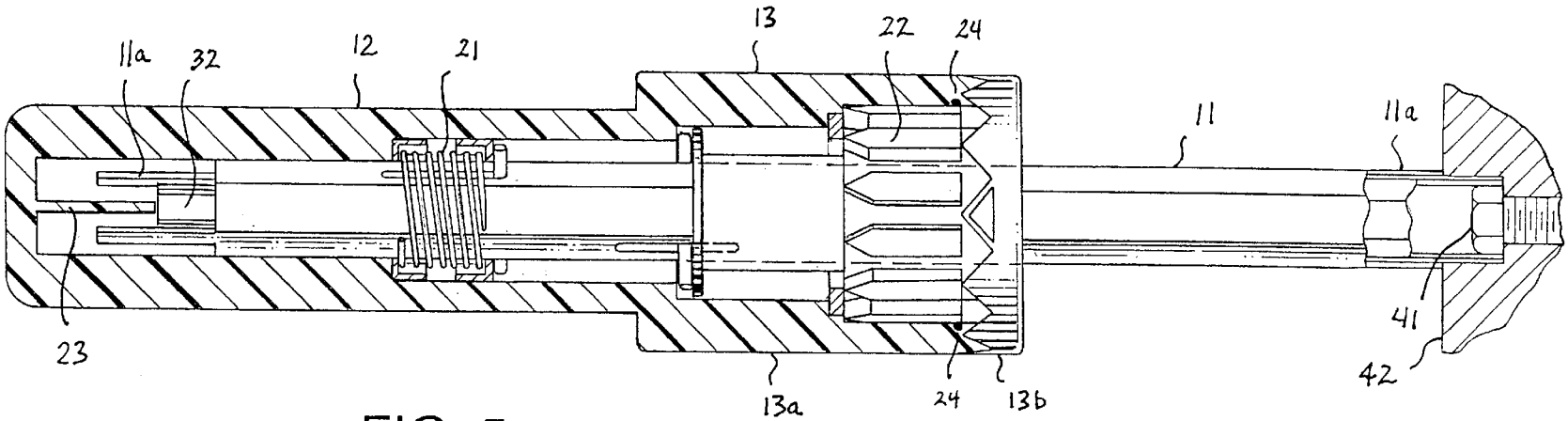
FIG. 5 is a partial longitudinal cross-sectional view of the nut driver of FIG. 1 with the socket portion pressed over a countersunk nut.

FIG. 5 is a partial longitudinal cross-sectional view of the nut driver 10 of FIG. 1 with the socket portion pressed over a countersunk nut 41. In this configuration, the working space does not allow all of the sockets that are larger than the nut to remain extended. As shown, the largest socket 11*a* is pushed rearward by the working surface 42 of the device or machine in which the nut 41 is mounted. The sockets 33 that are smaller than the nut are also pressed rearward into the handle, although a lesser amount than the largest socket since the nut is countersunk.

Figure 6:
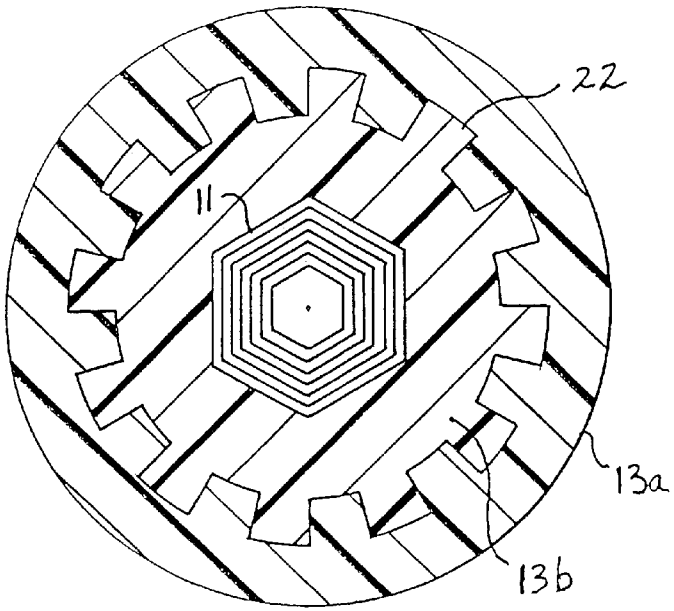
FIG. 6 is a lateral cross-sectional view of an adjusting mechanism of the nut driver of FIG. 1 taken along line 6—6 of FIG. 2.

FIG. 6 is a lateral cross-sectional view of the adjusting mechanism 13 of the nut driver 10 of FIG. 1 taken along line 6—6 of FIG. 2. This view illustrates the functioning of the splines 22 which prevent rotation of the adjusting mechanism after a socket size is selected and the rearward portion 13*a* and the forward portion 13*b* are pushed back into contact. The splines are connected to the forward portion 13*b*. When the two portions are in contact, the splines slide into matching slots formed in the rearward portion 13*a*, thus preventing rotation of the two portions with respect to each other. When the two portions are separated, the splines are pulled out of the slots, thereby allowing the two portions to be rotated, and the socket size selected.

Figure 7:
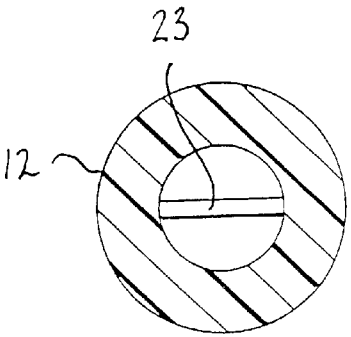
FIG. 7 is a lateral cross-sectional view of the handle of the nut driver of FIG. 1 taken along line 7—7 of FIG. 2.

FIG. 7 is a lateral cross-sectional view of the handle 12 of the nut driver 10 of FIG. 1 taken along line 7—7 of FIG. 2. This view illustrates the hollow body of the handle 12 and the size selector paddle 23 which is laterally mounted in the interior thereof. When the handle and rearward portion 13*a* of the adjusting mechanism are rotated in relation to the forward portion 13*b* of the adjusting mechanism, the selector paddle rotates in relation to the socket portion. As noted above, each socket size has two prongs 33 mounted at a unique angular position 180 degrees apart. When the selector paddle 23 is aligned with the prongs of a particular socket, that socket is held by the selector paddle in the forward operative position.

The selector paddle is a member of such size and shape, for example a rectangular plate, that it can be positioned to engage only one particular set of prongs at a time. Typically, this set of prongs will be associated with a single socket. The selector paddle therefore provides the means by which the operative socket is selected. In an alternate embodiment, the selector paddle also moves longitudinally so that it can engage and advance a set of prongs and the corresponding socket.

Figure 8:
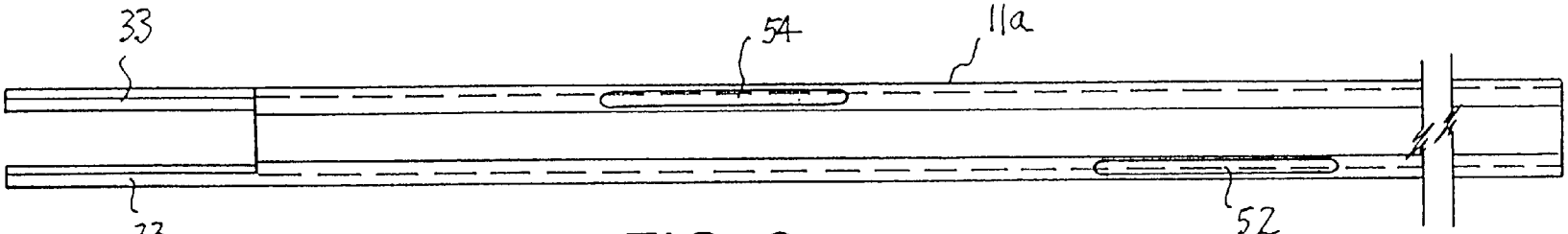
FIG. 8 is a side elevation view of a single socket.

FIG. 8 is a side elevation view of a single socket 11*a*. Two socket prongs 33 are illustrated extending rearward from the socket. Each socket is provided with one or more, and preferably two, prongs extending longitudinally from the end of the socket opposite its nut-engaging end. The prongs have a socket end and a free end. The prongs can be of any suitable size and shape, but must fit inside the next larger socket-and-prong combination (or otherwise be configured to not interfere with the desirable longitudinal movement of the other sockets and prongs). Some or all of the prongs may have a laterally-extending positioning pin or hook that can serve to support or engage a biasing device, such as a spring. Preferably, each socket-and-prong combination has the same longitudinal dimension as the others. Two elongate slots 52 and 54 are formed within each socket, the function of which is described below in connection with FIG. 9.

Figure 9:
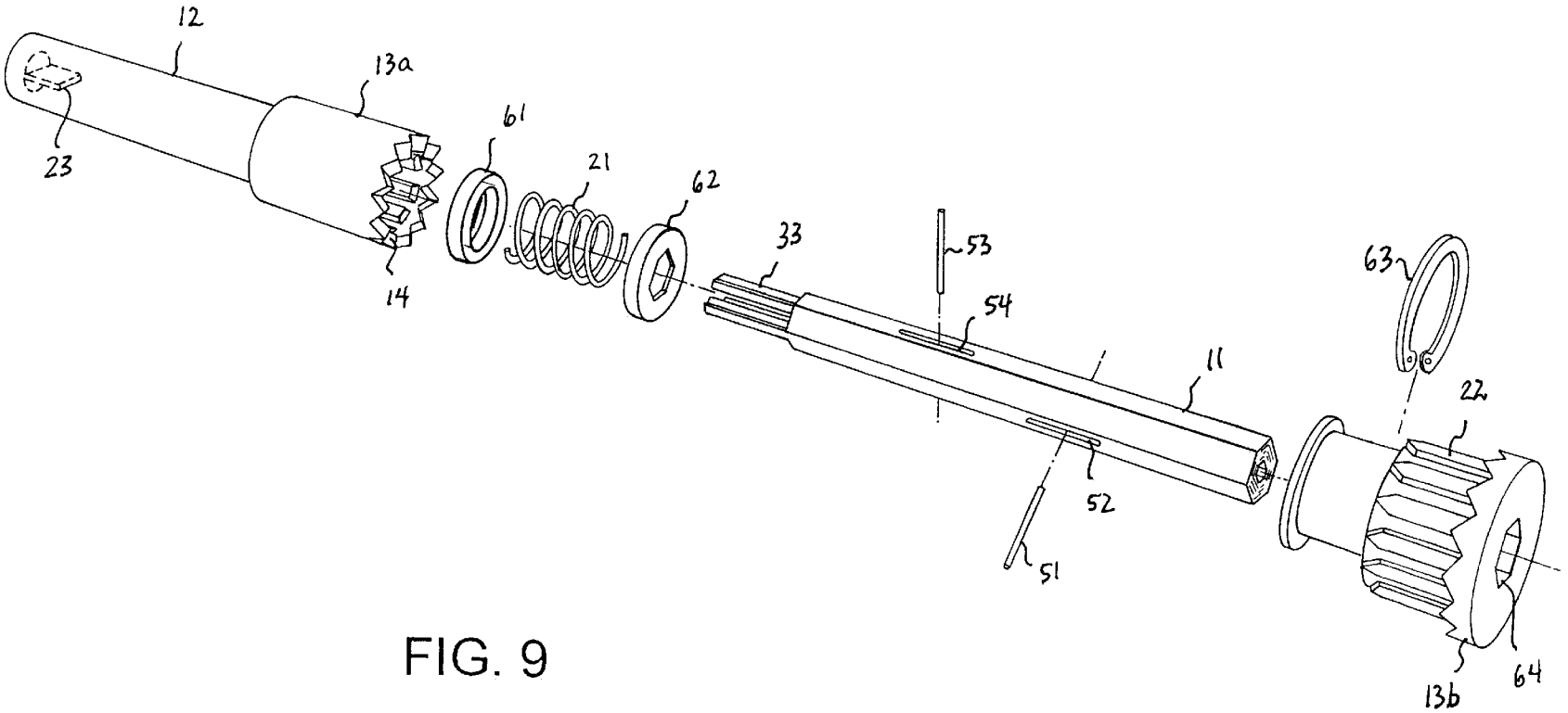
FIG. 9 is an exploded perspective view of the first embodiment of the nut driver of the present invention.

FIG. 9 is an exploded perspective view of the first embodiment of the nut driver 10 of the present invention. In addition to the components described above, the nut driver also includes a rear spring collar 61 and a forward spring collar 62 for the spring 21, and retainer clip 63 which prevents the driver from coming apart when the rearward portion 13*a* and the forward portion 13*b* of the adjusting mechanism are separated. Within the socket portion 11, the sockets are held in place by a lateral retaining pin 51. The lateral retaining pin passes through the elongate slot 52 which is formed in each socket. The slot allows each socket to slide longitudinally with respect to the others notwithstanding the pin. An additional lateral pin, spring pin 53, extends through a corresponding second elongate slot 54. The spring pin is contacted from the rear by the forward spring collar 62, and thereby holds the sockets in the extended position.

The socket portion 11 extends through a hexagonally shaped aperture 64 which transfers rotational torque from the forward adjusting portion 13*b* to the socket portion. The multi-socket nut driver of the present invention thus assembled can be used to turn a nut of any size that corresponds to the size of one of its sockets. When the operative socket is (or remains) advanced and engages the nut, the inner sockets, if they are not already retracted, will move into a retracted position as they are forced back by the nut itself. In an alternate embodiment, the multiple-size nut driver of the present invention will itself advance the operative socket, or retract others, or both. In this embodiment the sockets may be biased to remain advanced or retracted, as desired.

It should be noted that if the outermost (largest) socket also serves as a handle, it may not require prongs, and the selector paddle in that case need not extend to reach it. In an alternate embodiment, each socket has three prongs and the selector paddle has three corresponding members extending from a center axis. In fact, any number of socket prongs may be used, although a single prong on each socket is less desirable since it imparts an unbalanced force onto the operative socket.

While typically the shape of the selector paddle 23 or plurality of paddle members correspond to the number of prongs 33 on each socket, this is not a requirement. In some instances, it may be desirable to vary the number of prongs from socket to socket. For example, while a smaller socket may have two prongs, a larger socket may have four prongs. In such a configuration, space is provided between prongs sufficient to receive any portion of the selector paddle not engaging a prong. In another embodiment the selector paddle may also be longitudinally movable along the axis of rotation so that the selector paddle itself can be retracted, positioned to engage the prongs of the operative socket, and then advanced to move the operative socket to the extended position.

Note that herein for convenience, the operative socket is be said to advance while the others retract. It is immaterial, however, whether the unused sockets actually retract or the operable socket advances, the same result being achieved by either action. The only requirement is that the selected socket and the unselected sockets can move relative to each other so that the unselected sockets can recede to allow the operative socket to receive the nut. The larger sockets normally need not retract for the nut to be turned, but the tool may be designed so that they do so. Although the retraction may be accomplished simply by force of the nut being engaged, in another embodiment the sockets are spring-biased to remain in a retracted position until engaged and advanced by the selector paddle 23.

The selector paddle 23 is preferably attached to one portion of the handle 12, which is rotatably movable with respect to the forward portion of the adjusting mechanism 13. The selector paddle is then positioned by rotating the handle. The handle may be fitted with a locking pushbutton assembly or similar device that must be operated before the handle is permitted to rotate. In another embodiment, the moveable handle portion/selector paddle assembly also moves longitudinally with respect to the forward portion of the adjusting mechanism and the sockets. In this embodiment, the handle may be spring biased, for example so as to bias the selector paddle against the selected prongs until manually retracted. In this case, the user selects the operable socket by moving one portion of the handle (and the selector paddle) away from the other and rotating it into position. The handle is then released, and the spring-biased selector paddle assembly advances. This action may also advance the operative socket. In this embodiment, space between prongs may also be provided to receive the entire selector paddle, properly positioned, when it is desired that no sockets be advanced.

In an alternate embodiment, instead of a single selector paddle a plurality of paddles are provided. These may be integrally formed with the movable handle portion, proximate to the free end of the prongs. This plurality of selector paddles may be spaced in a staggered fashion to selectively engage one set of prongs. In this embodiment, the prongs may occupy substantially the same angular position (or positions, if each socket has multiple prongs) so as to engage only those paddles corresponding to the selected size socket. Of course, any arrangement of paddles and prongs that enables socket selection may be used.

In yet another embodiment, the tool is assembled for hand operation but provided with an outer casing that attaches to the selector paddle through a ratchet assembly, allowing the turning force to be selectively applied in both or only one direction of rotation.

Figure 10:
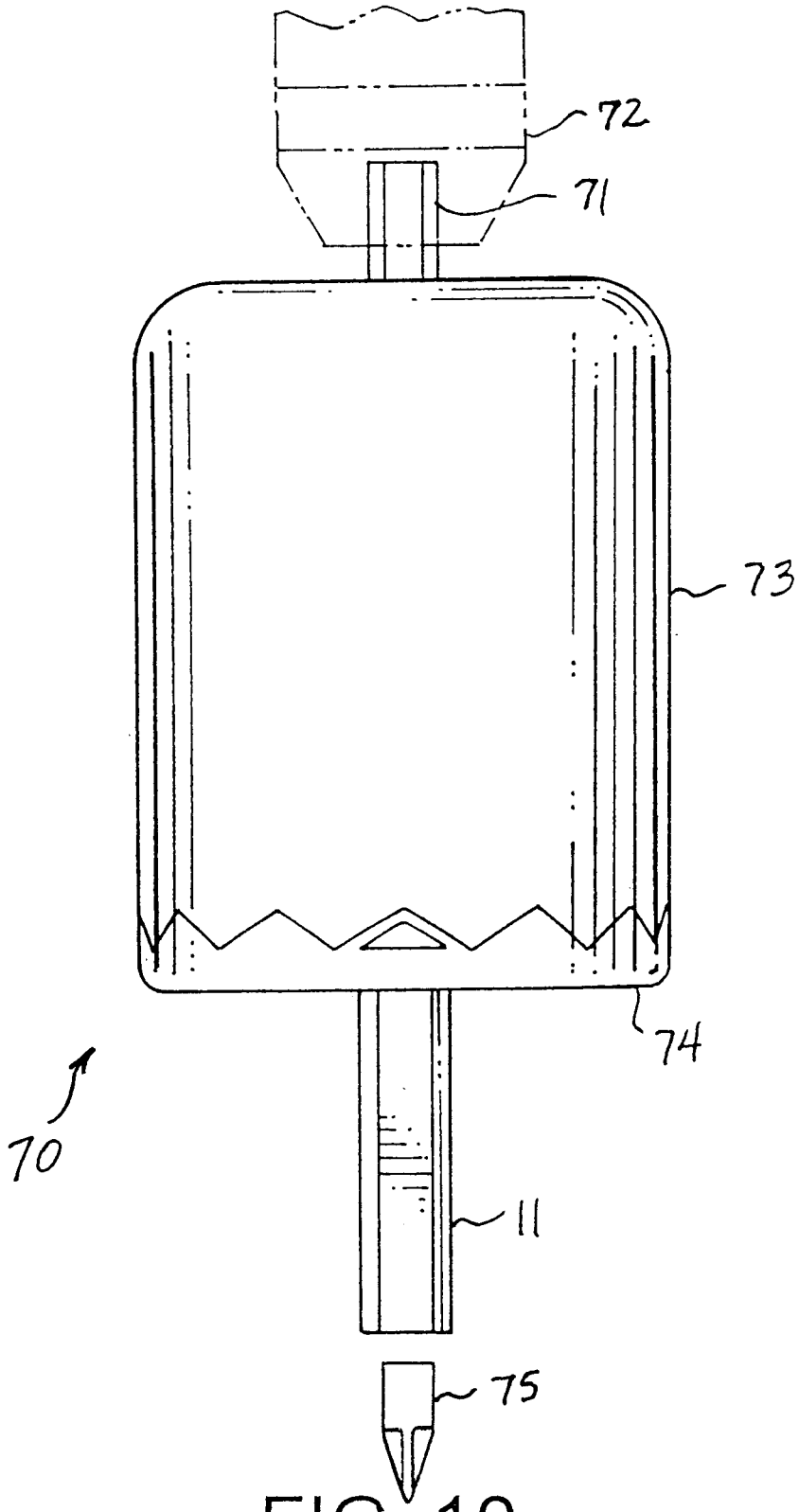
FIG. 10 is a rotated side elevation view of a second embodiment of the nut driver of the present invention with a drill chuck shown in phantom.

In the embodiments described above, the tool is assembled to be turned by hand. In an alternative embodiment shown in FIG. 10, a socket and selector paddle assembly 70 is provided with an extension-bit 71 sized to fit into the chuck 72 of a mechanized torqueing device such as a drill. Other torqueing devices may also be used to apply torque to the sockets such as a wrench, a ratchet, pliers, and the like. An outer casing 73 covers the rest of the assembly and part of the socket portion 11. FIG. 10 also illustrates an optional interchangeable screwdriver tip 75 that may be inserted into the socket portion 11 along the longitudinal axis of the nut driver. The screwdriver tip fits snugly within one of the sockets, and the nut driver can thereby be utilized as a screwdriver.

Figure 11:
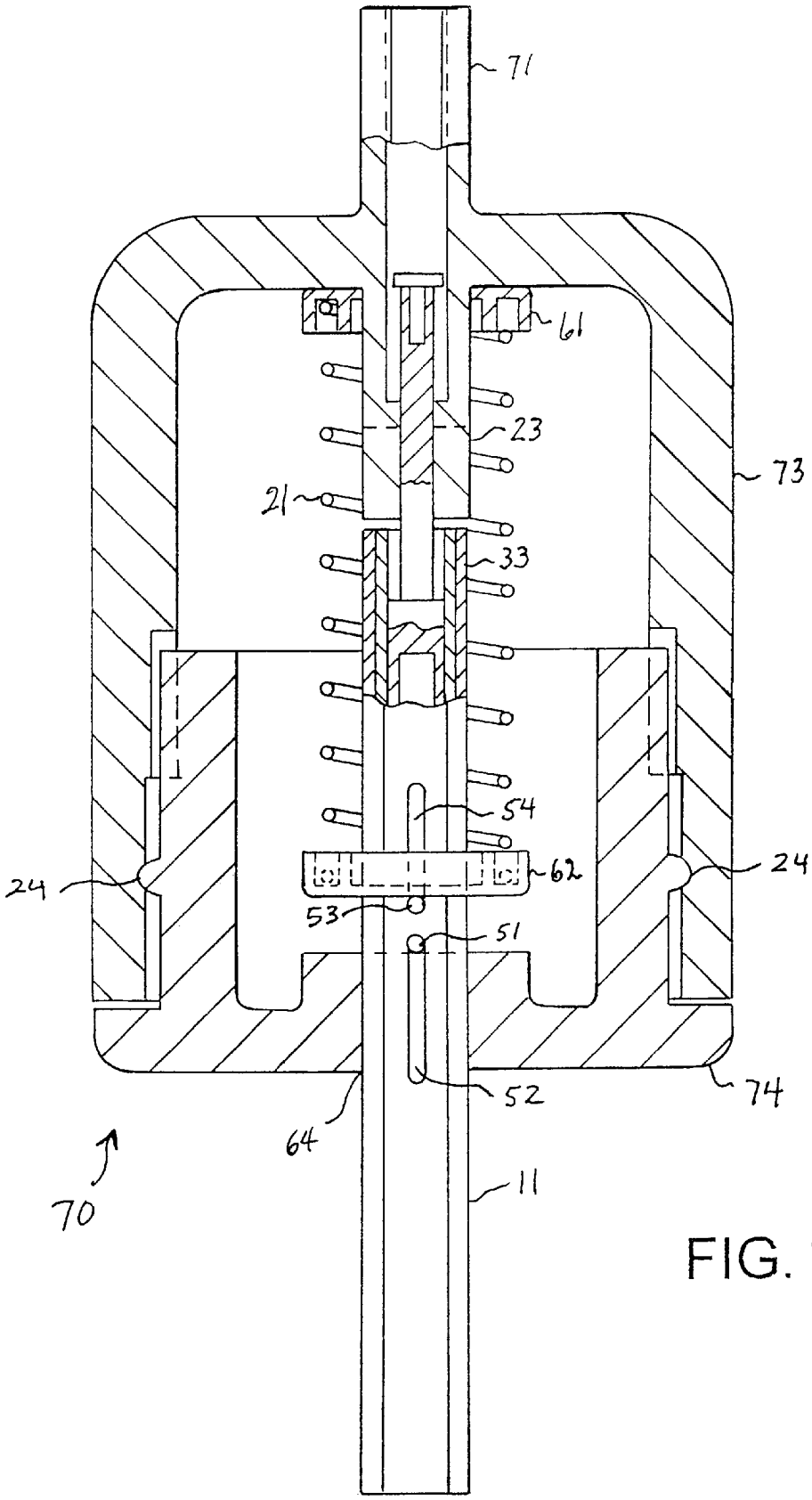
FIG. 11 is a partial longitudinal cross-sectional view of the nut driver of FIG. 10.
Figure 12:
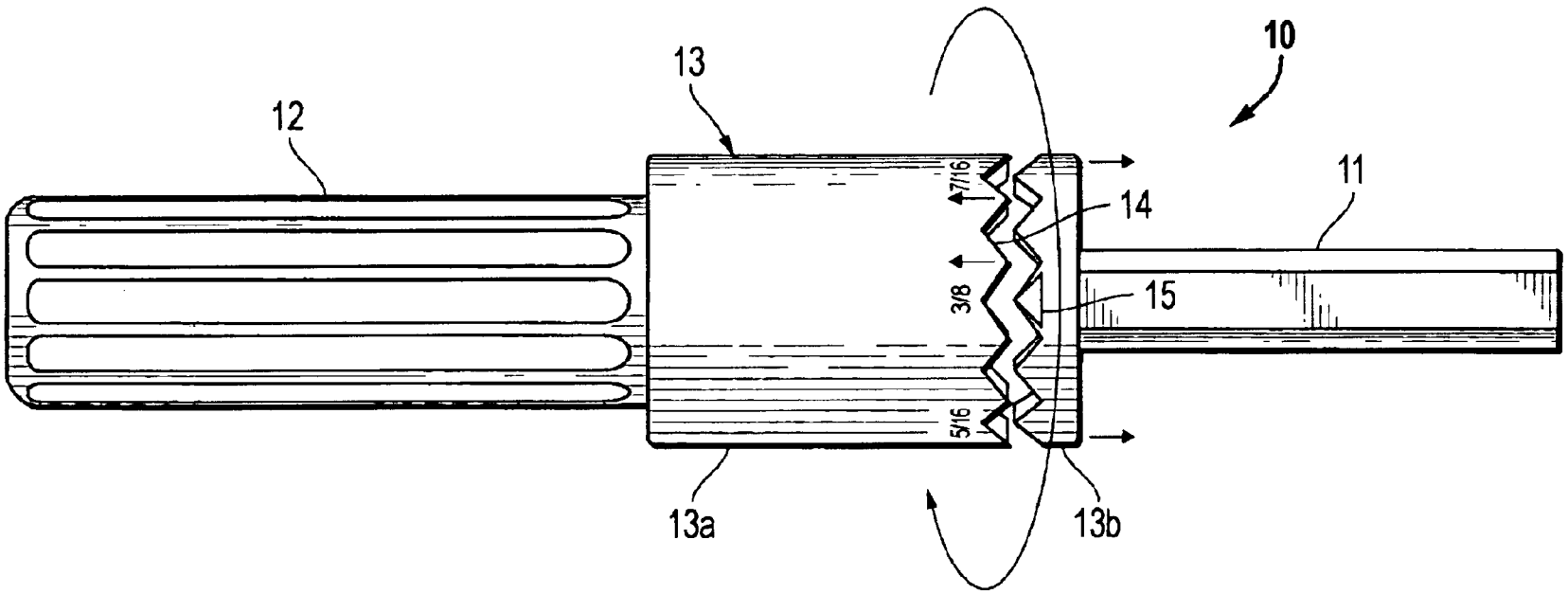
FIG. 12 is a side elevation view of the nut driver of FIG. 1 in an extended position.

FIG. 11 is a partial longitudinal cross-sectional view of the nut driver of FIG. 10 showing additional details of the operation thereof. In one such embodiment, the extension-bit 71 is integrally-formed or fixedly attached to the outer casing 73, to which the selector paddle 23 is also affixed. The outer casing engages a forward adjusting portion 74 that in turn engages the plurality of sockets (for example, by engaging the outermost socket). When engaged, the outer casing and the forward adjusting portion turn with the extension-bit, and translate the rotational torque to the nut driving sockets as they pass through the hexagonally shaped aperture 64 in the forward adjusting portion 74. When disengaged, typically by longitudinal movement, the outer casing and the forward adjusting portion rotate with respect to each other, causing the selector paddle 23 to rotate with respect to the sockets (and prongs 33) so that a particular size socket can be selected.

In another such embodiment, the selector paddle 23 is connected directly to the extension-bit, which extends though an aperture in the outer casing 73 so that the casing remains stationary and does not turn with the sockets 11 assembled inside it. Rotational torque is translated from the drill 72 to the sockets 11 by the force of the selector paddle 23 against the unadvanced socket prongs 33, while the stationary outer casing 73 may be held by the operator to stabilize the tool. In this embodiment, of course, the lateral extension or pin 51, if present, does not engage the outer casing.

It is thus believed that the operation and construction of the present invention will be apparent from the foregoing description. While the method, apparatus and system shown and described has been characterized as being preferred, it will be readily apparent that various changes and modifications could be made therein without departing from the scope of the invention as defined in the following claims.

What is claimed is:

1. A multiple-size nut driver comprising;

a socket portion comprising:

a plurality of concentric hexagonal sockets slidably mounted along a longitudinal axis of the driver, each of said sockets sliding between a forward operative position and a rearward retracted position, and each of said sockets having an inside dimension sized to snugly fit over a nut of a particular size, each socket having at least one prong extending rearward from a rear surface of the socket, the prong for each socket being angularly displaced from the prongs extending rearward from the other sockets in the plurality of sockets;

a socket selector mounted behind the plurality of concentric hexagonal sockets, said selector holding a selected socket in the forward operative position while allowing unselected sockets to retract to the rearward retracted position, wherein the socket selector includes a rotatable selector paddle laterally mounted behind the prongs that is rotated until the selector paddle aligns with the prong on a socket of a desired size, said selector paddle engaging the aligned prong and holding the socket of the desired size in the forward operative position; and a handle connected to the socket portion for rotating the socket portion;

whereby the selected socket is placed over a nut, and turns the nut when the socket portion is rotated by the handle.

2. The multiple-size nut driver of claim 1 further comprising an adjusting mechanism connected to the handle, said adjusting mechanism having a plurality of socket-size indicators around an exterior perimeter thereof.

3. The multiple-size nut driver of claim 2 wherein the selector paddle is laterally mounted in the handle, and the handle and adjusting mechanism are rotatably mounted to the socket portion for aligning the selector paddle with the prong on a socket of a desired size, and for aligning a size selector indicator with one of the socket-size indicators on the exterior perimeter of the adjusting mechanism.

4. The multiple-size nut driver of claim 3 wherein the handle and socket portion include a selectable locking mechanism that prevents the handle from rotating in relation to the socket portion when the size selector indicator on the handle is aligned with one of the socket-size indicators on the socket portion.

5. The multiple-size nut driver of claim 4 wherein the handle and adjusting mechanism are slidably mounted to the socket portion so that the adjusting mechanism and the socket portion can be longitudinally separated, and the nut driver further comprises a handle spring that is biased to hold the handle and adjusting mechanism in contact with the socket portion, thereby engaging the locking mechanism;

whereby the handle and socket portion may be slidably separated and then rotated in relation to each other for selecting a socket size, and then slidably contacted to engage the locking mechanism.

6. A multiple-size nut driver comprising:

a socket portion comprising a plurality of concentric hexagonal sockets slidably mounted along a longitudinal axis of the driver, each of said sockets sliding between a forward operative position and a rearward retracted position;

a socket selector paddle mounted behind the plurality of concentric hexagonal sockets, said selector paddle contacting a prong on a selected socket to hold the selected socket in the forward operative position while allowing unselected sockets to retract to the rearward retracted position; and an extension-bit connected to the socket portion for rotating the socket portion with a torqueing device, the extension-bit being fixedly attached to an outer casing that covers the socket portion and socket selector paddle, said outer casing imparting rotational torque to the socket portion through a hexagonally shaped aperture in a forward wall of the casing through which the socket portion extends;

whereby the selected socket is placed over a nut, and turns the nut when the socket portion is rotated by the torqueing device.

7. The multiple-size nut driver of claim 6 wherein the extension-bit extends though an aperture in a rear wall of the outer casing, and is connected directly to the selector paddle, whereby the outer casing remains stationary and does not rotate with the sockets, and rotational torque is translated from the torqueing device to the sockets by the selector paddle acting against the prongs of retracted sockets.

8. The multiple-size nut driver of claim 6 wherein the torqueing device is a mechanical drill.

* * * * *